United States Patent [19]

Setterberg

[11] Patent Number: 4,614,436

[45] Date of Patent: Sep. 30, 1986

[54] METHOD OF VIBRATING BULK MATERIAL IN MOULDS

[76] Inventor: Lars I. Setterberg, Mjölnartorpsvägen 11, S-182 63 Djursholm, Sweden

[21] Appl. No.: 701,174

[22] Filed: Feb. 13, 1985

[30] Foreign Application Priority Data

Feb. 15, 1984 [SE] Sweden ..... 8400816

[51] Int. Cl.[4] ..... B01F 11/00

[52] U.S. Cl. ..... 366/114; 141/DIG. 1; 164/71.1; 264/71; 425/3

[58] Field of Search ..... 366/108, 110, 114, 116; 425/3; 264/69, 71, 72; 164/71.1, 260, 416, 478; 141/DIG. 1, 77

[56] References Cited

U.S. PATENT DOCUMENTS

| | | | |
|---|---|---|---|
| 720,053 | 2/1903 | McKibben | 141/77 X |
| 1,751,087 | 3/1930 | Jackson | 366/114 |
| 3,106,652 | 10/1963 | Burt | 366/114 |
| 3,528,144 | 9/1970 | Haponski | 366/114 |
| 3,633,878 | 1/1972 | Mendius | 366/114 |
| 3,724,819 | 4/1973 | Varnum | 366/114 |
| 4,353,261 | 10/1982 | Salani | 366/116 |

*Primary Examiner*—Philip R. Coe

*Attorney, Agent, or Firm*—Young & Thompson

[57] ABSTRACT

A method of vibrating mass material in moulds or forms is described, there being used a vibrator attached to the mould, for such as the vibration of refractory masses for lining metallurgical vessels or the vibration of concrete in forms. The invention is distinguished in that vibration takes place continuously during movement of the vibrator on the mould in time with the mould being filled with mass material. The vibrator, which is attached to a plate having a built-in magnet, preferably an electromagnet, is attached to the mould and moved on it with the aid of a device acting on the vibrator itself, the device being controlled by a driven member, e.g. a screw, a power ram or the like.

4 Claims, 3 Drawing Figures

METHOD OF VIBRATING BULK MATERIAL IN MOULDS

Figure 1:
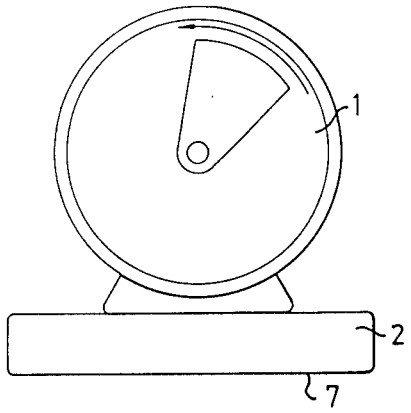

Apart from conveying bulk goods by vibration, vibrators are also used for compacting material masses, e.g. in road-making, concrete casting in moulds or forms etc, and they can also be used for increasing the density of material masses of different kinds in different moulds or forms.

In concrete casting there are used tubular vibrators which are pushed down into the concrete poured into the form, or vibrators which are rigidly mounted on the outside of the form, these vibrators usually being bolted onto steel beams fixed to the form.

For increasing the density of different kinds of material masses in moulds, there are used templates which are removable after the density-increasing operation, e.g. in lining metallurgical vessels. One or more vibrators are attached to the template, usually by welding or by bolting to reinforcements on it.

It is thus usual to fasten a vibrator as rigidly as possible to that which is to be vibrated, whether it is a vibrating conveyor or a mould. The idea behind this is that the movements of the vibrator will be transferred as intimately as possible with as little a loss as possible to that which is to be vibrated.

When concrete or a material mass in a mould is to be vibrated with the aid of a vibrator or vibrators mounted on the exterior of the form, these should be mounted at several levels to cover the entire depth of the form as well as its length. In such cases the vibrators at different levels are often laterally displaced in relation to each other.

In the known embodiments the vibrators are rigidly mounted, and if they are to be moved, the vibration must be interrupted, the vibrators removed and subsequently attached again at a new place. This is extremely time-consuming.

In contrast to this, the present invention relates to a method of vibrating material masses in moulds or shuttering with the aid of at least one vibrator mounted on the mould, this method being distinguished in that vibration takes place continuously while the vibrator is moved on the mould, and is applicable to such as the vibration of refractory masses for lining metallurgical vessels or vibrating concrete in moulds and forms.

It is possible to collect several vibrators into units or packs, which are moved on the mould during vibration.

In such cases, different units or packs can be moved simultaneously or independently of each other.

During vibration, the vibratory action on the mould by the vibrator or vibrators can be varied by varying the acceleration force, amplitude or frequency provided by the vibrator(s). The vibrator or vibrators are attached to magnets, preferably electromagnets, with the aid of which the vibrators are attached to the mould or moulds.

The field strength of the electromagnet or electromagnets can be varied during vibration, and thereby the attachment force thereof to the mould. The vibration process in the vibrated material can thus be affected.

When moulds are made from non-magnetic material, magnetic material in the form of band or plate can be provided for attaching the vibrator or vibrators to the mould.

In a particular embodiment for vibrating refractory masses in lining metallurgical vessels, which comprise casing and bottom, the method in accordance with the invention is distinguished in that the lining is vibrated in situ between the casing and, where so is applicable, between the casing secondary lining and a removable template by at least one vibrator being attached to, and moved along, the inside of the template, refractory mass being filled in the space between the casing or secondary casing lining and the template, which is removed after any terminating post-treatment of the vibrated lining.

In one embodiment the template can be parted into several sections which are connected together, with seals such as rubber strips between the sections.

The refractory mass may have 4–8% moisture, preferably 4.5 to 5% moisture or it may be dry.

In an embodiment a vibrator or vibrator pack is movable on a mould during vibration, with the aid of means acting on the pack or the housing of the vibrator itself, these means being controlled by a driven member such as a screw, a power ram or the like.

Figure 2:
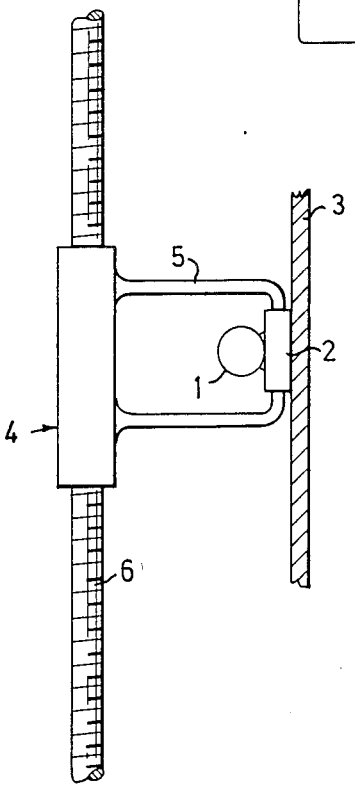
Figure 3:
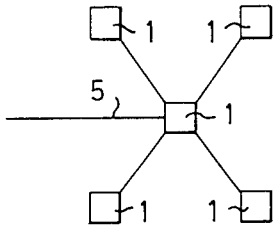

The invention will now be described in connection with the accompanying schematic drawing, where FIG. 1 illustrates a vibrator with eccentric weight and attachment plate, FIG. 2 illustrates a mould wall with a vibrator applied to it, the vibrator being movable with the aid of a driving means, and FIG. 3, finally, illustrates in a view from above, from one side or from below five vibrators gathered together into a unit or a pack.

To enable moving a vibrator or a unit of vibrators on a mould during vibration, the vibrator 1 (here illustrated as a mechanical vibrator) is equipped with an attachment plate 2, containing a magnet, preferably an electromagnet (not shown). With the aid of magnetic force the vibrator or vibrator unit can be attached to a mould 3, and by a driving means 4 containing a drivable arm 5 (mounted on a drivable screw in the example illustrated on the drawing) the vibrator or vibrator unit can be moved on the mould 3. In the example illustrated in FIG. 2, the vibrator 1 with its electromagnetic attachment plate 2 can be moved upwards or downwards, or if the arm 5 is locked to the screw 6, the vibrator can be moved round the inside of the mould 3 if the mould is round.

The face 7 of the attachment plate 2 engaging against the mould 3 may be flat or curved or otherwise adjusted to the contour of the mould 3.

If the material in the mould is not magnetic, steel strip or steel plate can be suitably incorporated with the mould so that the vibrators can be attached to the mould.

For vibration the electromagnet (not shown) in the vibrator attachment plate 2 is activated first, thus attaching the plate to the mould 3. The vibrator 1 is then started for vibrating the mould wall 3. If the attachment force in the electromagnet of the attachment plate 2 is adjusted to the force developed by the vibrator, the unit can be moved during the vibration in progress. There is thus afforded the opportunity in accordance with the invention of continuous vibration during movement of the vibrator on the mould, suitably in time with the mould being filled with mass material, or in relation to the properties thereof. Movement of the vibrator or vibrator unit can be performed with some suitable aid, e.g. an arrangement according to FIG. 2, where the connection between the arm 5 and vibrator 1,2 is arranged in some suitable dampening way.

The movement of a vibrator 1 on a mould wall 3 during vibration of the latter is possible by the coordination between the forces developed in the vibrator 1 and the force retaining the attachment plate 2 on the mould wall. Different vibratory effects may be obtained, e.g. by varying the forces developed by the vibrator in relation to the field strength of the magnet, and vice versa. A further salient feature of the method in accordance with the invention is that by the continuous vibration, which takes place the whole time the mass material is filled, the individual particles in the material are kept continuously moving with little mutual friction, movement continuing until their free oscillation space is so small that the desired increase in density of the material has been achieved.

With an intermittent process there is the risk that joint zones are formed between the different fillings of the material mass, these zones being weak from the aspect of material strength. This is avoided in the method in accordance with the invention, and there is obtained a completely homogeneous, vibrated product.

As an example may be mentioned that a refractory mass with 4.5 to 5% moisture content, and vibrated in accordance with the inventive method, obtained a porosity after firing of 14–17%, which is a value fully comparable with that which can be obtained for high-quality fired refractory bricks.

I claim:

1. In a method of vibrating mass materials in moulds, forms or vessels including magnetically attractive walls with the aid of at least one vibrator mounted on a mould, form or vessel, said vibrator being fastened to a magnet with the aid of which said vibrator is attached to the walls for mounting on the mould, form or vessel; the improvement comprising carrying out vibration with said vibrator continuously while continuously moving the vibrator along the mould, form or vessel at the same time the mould, form or vessel is being filled with said material, and continuously maintaining magentic attraction between said magnet and said walls during said vibration and during movement of the vibrator along the mould.

2. A method as claimed in claim 1, and providing a plurality of vibrators that are moved simultaneously during vibration.

3. A method as claimed in claim 1, and moving said vibrator by the operation of power means.

4. A method as claimed in claim 3, and employing a screw jack as said power means.

* * * * *